US012121786B2

(12) United States Patent
Hong

(10) Patent No.: US 12,121,786 B2
(45) Date of Patent: Oct. 22, 2024

(54) ACCESSORY POUCH FOR GOLF

(71) Applicant: GolfzonDeca Inc., Seongnam-si (KR)

(72) Inventor: Jae Sung Hong, Seongnam-si (KR)

(73) Assignee: Golfzon Deca Inc., Seongnam-si (KR)

( * ) Notice: Subject to any disclaimer, the term of this patent is extended or adjusted under 35 U.S.C. 154(b) by 228 days.

(21) Appl. No.: 17/667,033

(22) Filed: Feb. 8, 2022

(65) Prior Publication Data

US 2023/0158379 A1 May 25, 2023

(30) Foreign Application Priority Data

Nov. 24, 2021 (KR) ..... 10-2021-0163819

(51) Int. Cl.
*A63B 57/20* (2015.01)
*A63B 55/00* (2015.01)

(52) U.S. Cl.
CPC ..... *A63B 57/20* (2015.10); *A63B 55/408* (2015.10); *A63B 2209/08* (2013.01); *A63B 2209/10* (2013.01); *A63B 2220/20* (2013.01)

(58) Field of Classification Search
CPC ..... A63B 57/20; A63B 57/00; A63B 55/408
USPC ..... 206/315.1; 224/928, 269, 158; 383/11
See application file for complete search history.

(56) References Cited

U.S. PATENT DOCUMENTS 3,007,568 A * 11/1961 Kurland ..... A45C 11/325 206/37.1
6,675,965 B2 * 1/2004 Holland ..... A45F 5/02 206/338
7,942,856 B2 * 5/2011 Lentini ..... A41D 13/1245 2/243.1
7,955,683 B1 * 6/2011 Ferrell ..... A63B 57/60 15/209.1
8,453,265 B2 * 6/2013 Forte ..... G09F 21/02 40/586
2002/0175100 A1 * 11/2002 Holland ..... B25H 3/00 224/183
2003/0006154 A1 * 1/2003 Chen ..... A63B 47/001 206/315.9
2006/0169731 A1 * 8/2006 Matulewic ..... A63B 57/00 224/684

(Continued)

FOREIGN PATENT DOCUMENTS

KR 20-1991-0019396 U 12/1991
KR 10-2003-0086139 A 11/2003

(Continued)

OTHER PUBLICATIONS

TRBL Golf Rangefinder Magnetic Hard Case Including Ball Markers, Monster Bro, on-line, retrieved on Nov. 22, 2022 , <URL: https://www.monsterbro.com/product/trbl-001> (5 pages total).

(Continued)

*Primary Examiner* — Rafael A Ortiz
(74) *Attorney, Agent, or Firm* — Sughrue Mion, PLLC

(57) ABSTRACT

Disclosed herein is an accessory pouch for golf for accommodating a golf accessory. The accessory pouch includes: a pouch body formed in an openable container, and configured to provide an accommodation space for a golf accessory; at least one magnet provided on one surface of the pouch body, and configured to detachably attach the pouch body to a metal plate while providing a magnetic force; and a magnet holder configured to fix the magnet to the one surface of the pouch body.

2 Claims, 4 Drawing Sheets

(56) References Cited

U.S. PATENT DOCUMENTS

| | | | | |
|---|---|---|---|---|
| 2008/0185414 | A1* | 8/2008 | Conlon | A45F 5/02 206/349 |
| 2010/0193559 | A1* | 8/2010 | Van Huyssteen | A63B 57/20 224/680 |
| 2018/0049493 | A1* | 2/2018 | Graves | A45C 13/1069 |
| 2018/0132586 | A1* | 5/2018 | Flaherty | B65D 81/3813 |

FOREIGN PATENT DOCUMENTS

| | | | |
|---|---|---|---|
| KR | 10-1717025 | B1 | 3/2017 |
| KR | 10-2021-0127367 | A | 10/2021 |
| WO | 03/092430 | A1 | 11/2003 |

OTHER PUBLICATIONS

[Callaway] Callaway Golf Rangefinder Case Mini, Lotte On, online, retrieved on Nov. 22, 2022, <URL: https://www.lotteon.com/p/product/LO1487263636> (4 pages total).

* cited by examiner

[Fig. 1]
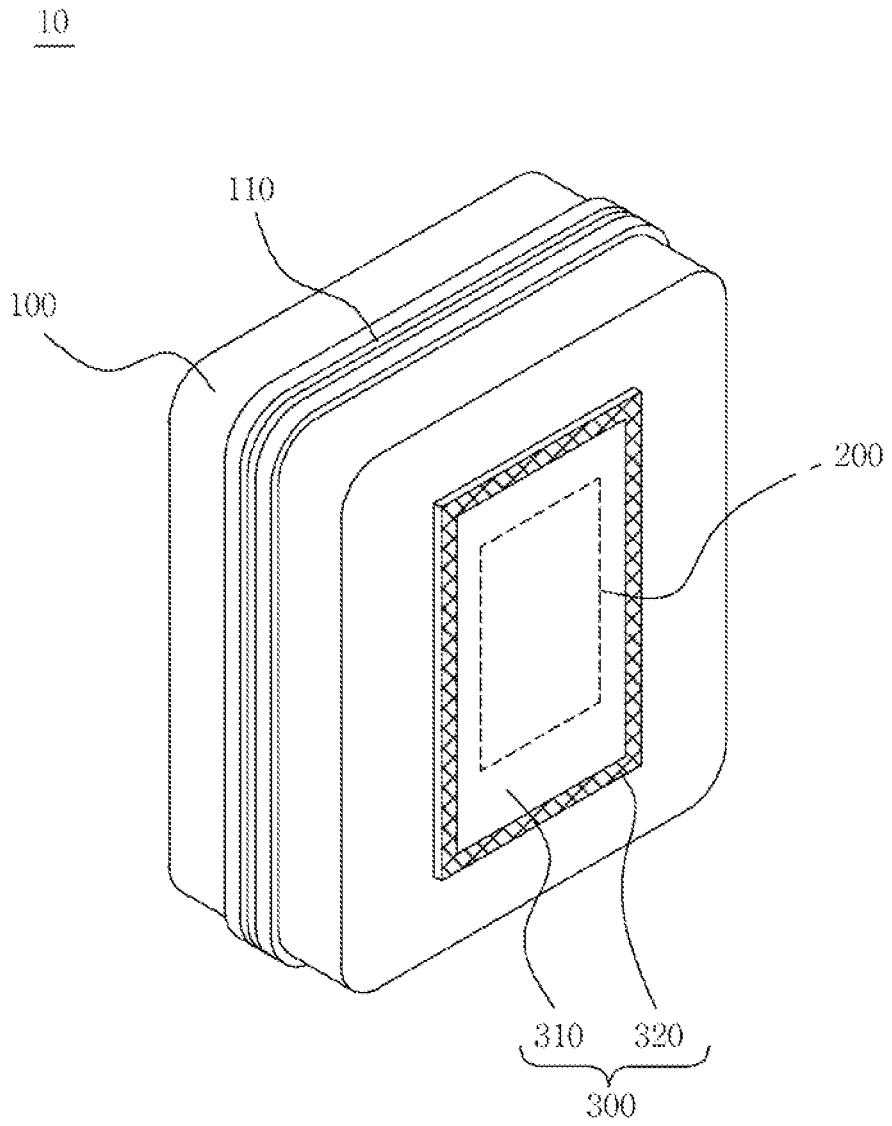

[Fig. 2]
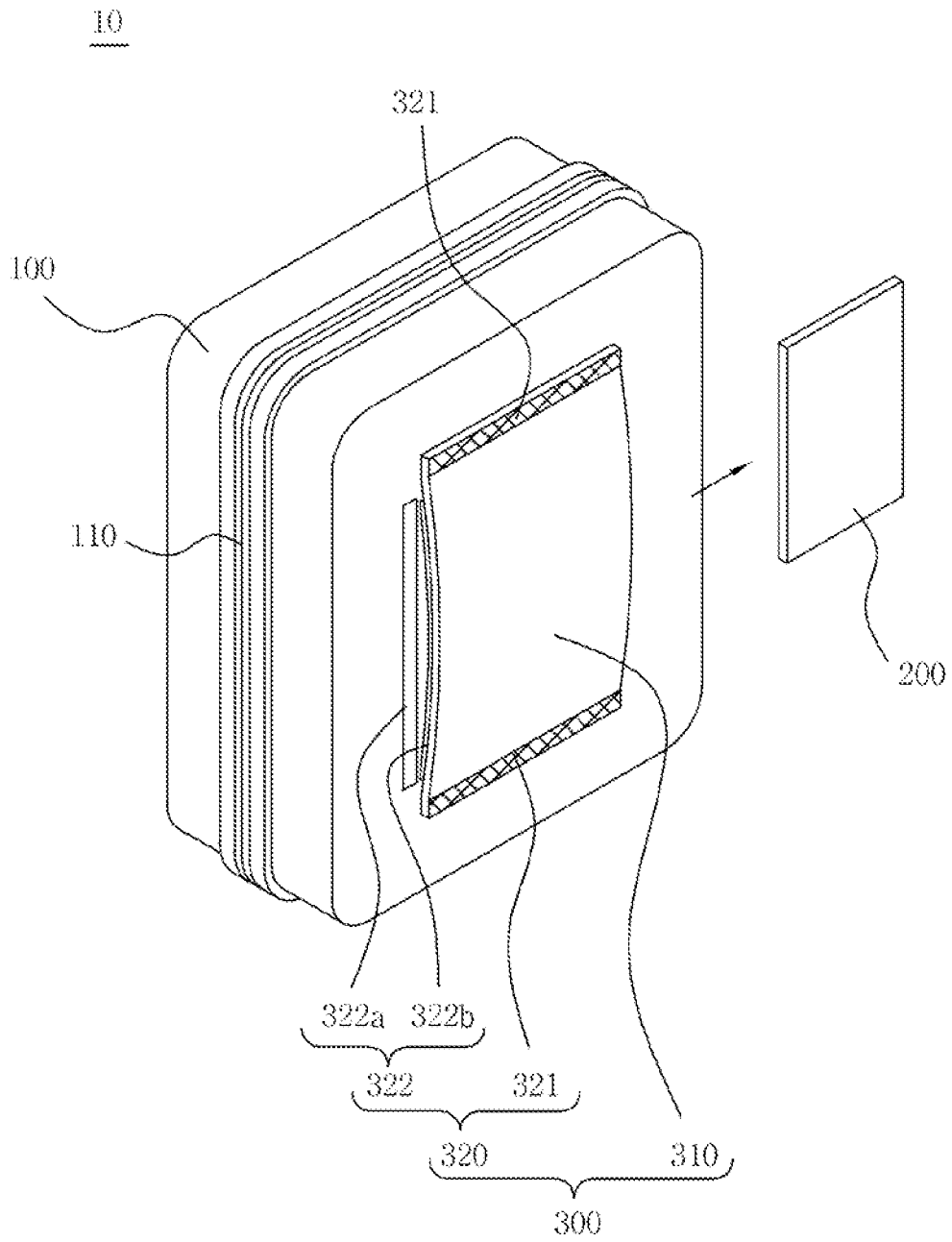

[Fig. 3]
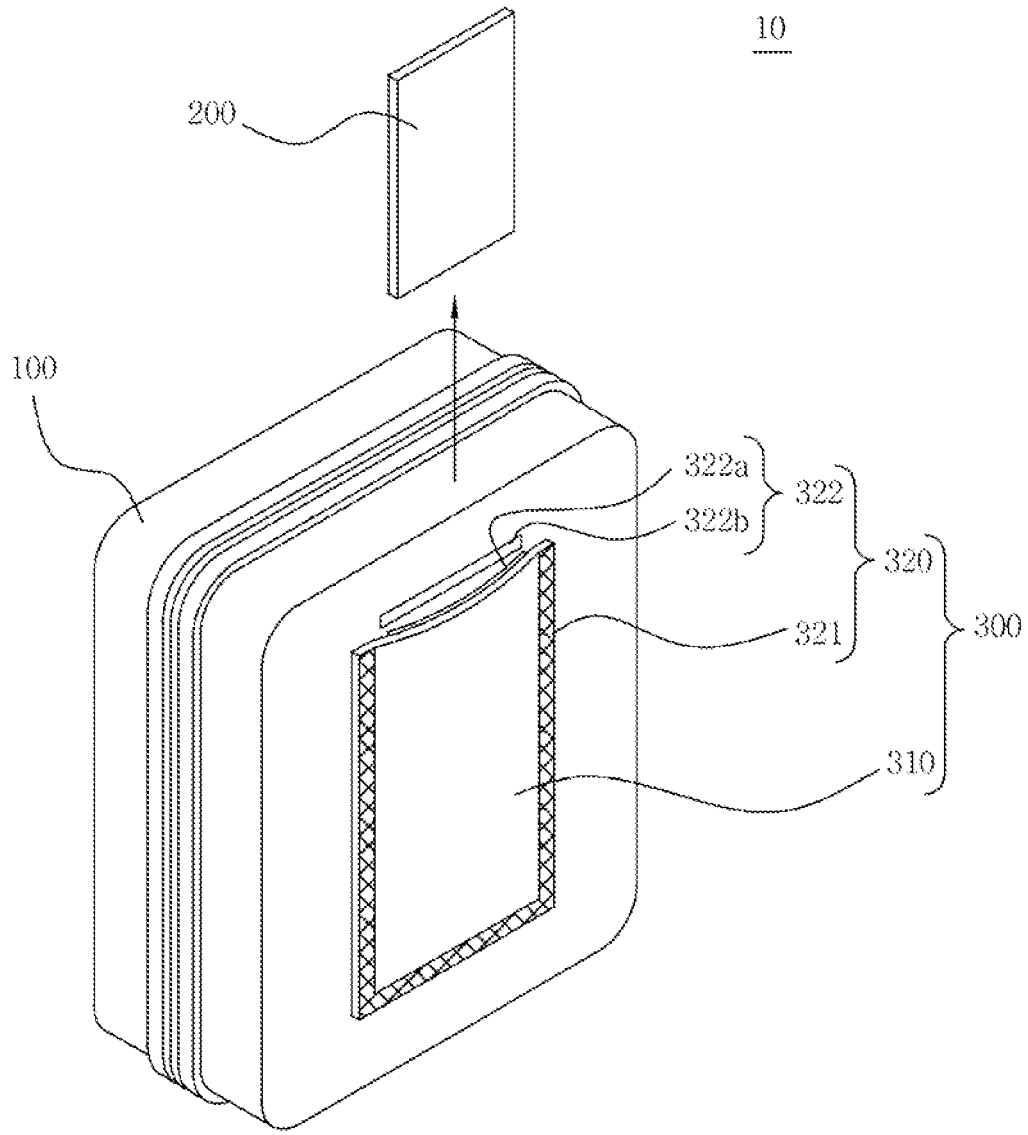

[Fig. 4]
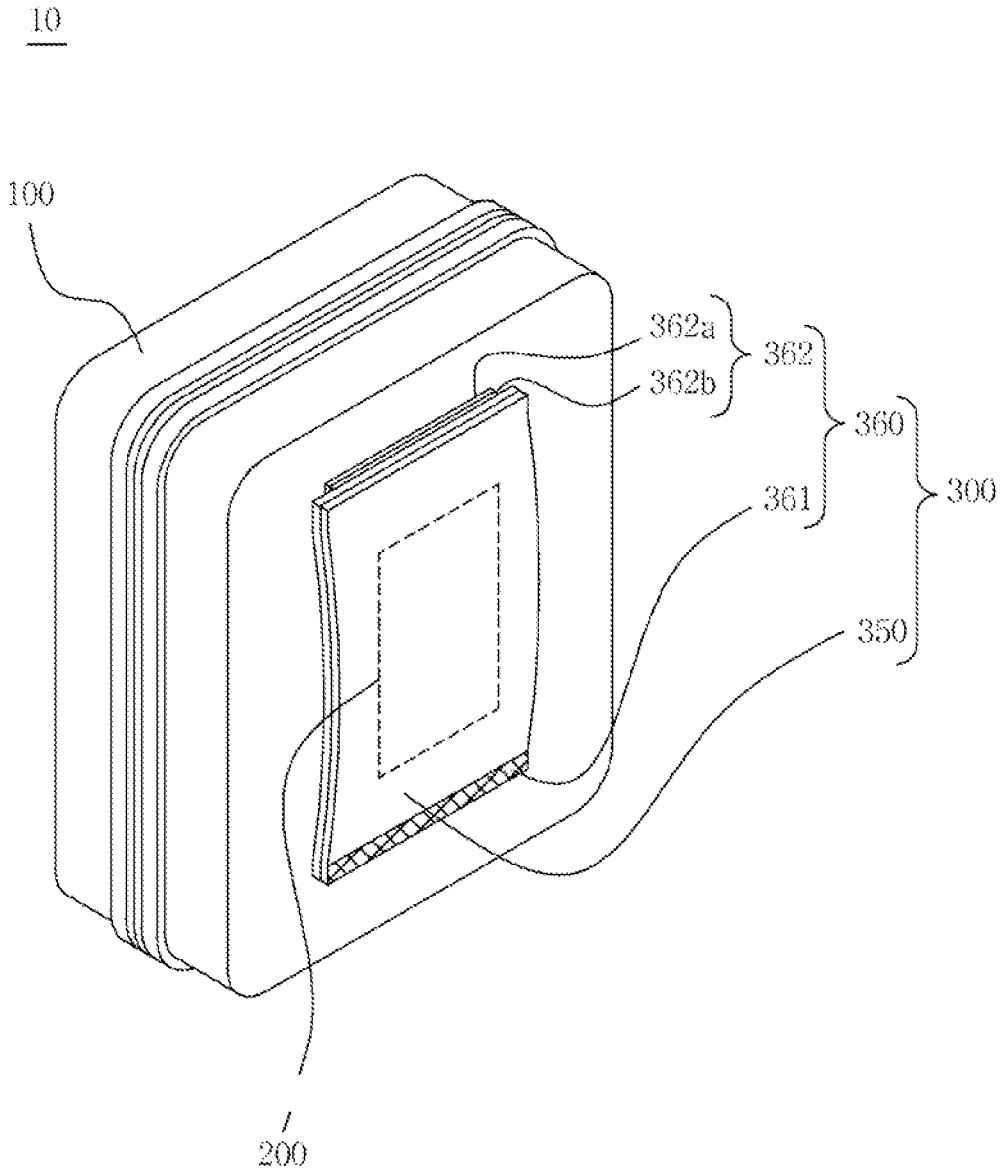

ACCESSORY POUCH FOR GOLF

This application claims the benefit of Korean Patent Application No. 10-2021-0163819 filed on 2021 Nov. 24, which is hereby incorporated by reference herein in its entirety.

BACKGROUND

1. Technical Field

The embodiments disclosed herein relate generally to an accessory pouch for golf, and more particularly to an accessory pouch for golf that, is capable of accommodating an accessory such as a range finder in the state of being attached to golf wear.

2. Description of the Related Art

In general, in order to play a golf game, various golf accessories, such as golf balls, ball markers, tees, golf gloves, and divots as well as golf clubs, and personal items are required, and required items are stored in various pockets of a golf bag and are used when necessary.

In particular, recently, during a game, a user carries a range finder capable of measuring a distance using a laser, and measures the distance to a hole more accurately.

For this purpose, recently, an accessory is put in a golf pouch and then carried, as disclosed in Korean Patent No. 10-1717025.

However, the related art described above is problematic in that the pouch is carried by hand or put in a golf bag, so that it is cumbersome to use or transport an accessory.

Accordingly, in recent years, a ring is formed in a pouch such that the pouch can be hooked and carried on the belt of golf wear, and thus an accessory such as a range finder can be immediately drawn out from the pouch and then used.

However, the related art described above has a problem in that since the pouch is always attached to the belt of golf wear, interference is caused or a correct posture is disturbed by the pouch in the process of swinging a golf club.

Therefore, there is required a new technology for overcoming the problems of the related art described above.

Meanwhile, the above-described background technology corresponds to technical information that has been possessed by the present inventor in order to contrive the present invention or that has been acquired in the process of contriving the present invention, and can not necessarily be regarded as well-known technology that had been known to the public prior to the filing of the present invention.

SUMMARY

An object of the embodiments disclosed herein is to present an accessory pouch for golf that can be easily attached to and detached from golf wear while accommodating a golf accessory.

In particular, an object of the embodiments disclosed herein is to present an accessory pouch for golf that allows a pouch body configured to provide an accommodation space to be attached to the metal plate of golf wear through the magnetic force of a magnet.

An object, of the embodiments disclosed herein is to present an accessory pouch for golf that is hooked on golf wear by allowing a part where a magnet is fixed to be converted into a ring shape as needed.

An object of the embodiments disclosed herein is to present an accessory pouch for golf that allows a magnet to be separated as needed.

According to an aspect of the present invention, there is provided an accessory pouch for golf for accommodating a golf accessory, the accessory pouch including: a pouch body formed in an openable container, and configured to provide an accommodation space for a golf accessory; at least one magnet provided on one surface of the pouch body, and configured to detachably attach the pouch body to a metal plate while providing a magnetic force; and a magnet, holder configured to fix the magnet to the one surface of the pouch body.

The magnet holder may include: a fixing band formed in a band shape having a larger area than the magnet, and configured to form an accommodation space for the magnet between itself and the pouch body while being fixed to the one surface of the pouch body; and a band fixing part configured to fix the outer edges of the fixing band to the pouch body.

The band fixing part may include: sewing portions configured to fix the upper and lower opposite ones of the outer edges of the fixing band to the pouch body; and a band fastener configured to convert the fixing band into a ring shape while a allowing the opening of the accommodation space by detachably fixing the left, and right opposite ones of the outer edges of the fixing band to the pouch body.

The band fixing part may include: sewing portions configured to fix three neighboring ones of the outer edges of the fixing band to the pouch body; and a band fastener configured to form the fixing band in a pocket shape while allowing the opening of the accommodation space by detachably fixing the remaining one of the outer edges of the fixing band to the pouch body.

The band fastener may include one of a pair of male and female Velcro fasteners, a pair of male and female magnets, a pair of male and female snap buttons, and a pair of male and female slide fasteners, the band fastener of which are attached to one outer edge of the fixing band and the pouch body, respectively, while forming a male and female pair and are coupled to each other.

The magnet holder may include: a magnet pocket formed in a pocket shape having a larger area than the magnet, and configured to accommodate the magnet; and a pocket fixing part configured to form the magnet pocket in a ring shape while fixing a part of the outer edges of the magnet pocket to the pouch body.

The pocket, fixing part may include: a pocket sewing portion configured to fix one of the upper, lower, left, and right outer edges of the magnet, pocket to the pouch body; and a pocket, fastener configured to form the magnet pocket in the shape of a ring by fixing one of the upper, lower, left, and right outer edges of the magnet, pocket, opposite to the pocket sewing portion, to the pouch body, and to allow the opening of the ring while allowing the separation of the fixing portion.

The pocket fastener may include one of a pair of male and female Velcro fasteners, a pair of male and female magnets, a pair of male and female snap buttons, and a pair of male and female slide fasteners, the pocket fastener of which are attached to one outer edge of the magnet pocket and the pouch body, respectively, while forming a male and female pair and are coupled to each other.

BRIEF DESCRIPTION OF THE DRAWINGS

The above and other objects, features, and advantages of the present invention will be more clearly understood from the following detailed description taken in conjunction with the accompanying drawings, in which:

FIG. 1 is a perspective view showing the overall configuration of an accessory pouch for golf according to an embodiment;

FIG. 2 is a perspective view showing another embodiment of a magnet holder;

FIG. 3 is a perspective view showing still another embodiment, of the magnet, holder; and FIG. 4 is a perspective view showing still another embodiment of the magnet holder.

DETAILED DESCRIPTION

Various embodiments will be described in detail below with reference to the accompanying drawings. The following embodiments may be modified and implemented in various different forms. In order to more clearly describe the characteristics of the embodiments, detailed descriptions of matters widely known to those of ordinary skill in the art to which the following embodiments pertain are omitted. Furthermore, in the drawings, parts not related to the description of the embodiments are omitted, and similar, reference numerals are allocated to similar parts throughout the specification.

Throughout the specification, when a component is described as being "connected" to another component, it includes not only a case where they are "directly connected" to each other but also a case where they are "connected with another component interposed therebetween." In addition, when a component is described as "including" a component, it means that the former component, may further another component, rather than excluding the other component, unless otherwise stated.

Embodiments will be described in detail below with reference to the accompanying drawings.

FIG. 1 is a perspective view showing the overall configuration of an accessory pouch for golf according to an embodiment, FIG. 2 is a perspective view showing another embodiment of a magnet holder, and FIGS. 3 and 4 are perspective views each showing still another embodiment of the magnet holder.

An accessory pouch 10 for golf according to an embodiment may include a pouch body 100, a magnet 200, and a magnet holder 300.

The pouch body 100 is a component configured to provide an accommodation space for a golf accessory. The pouch body 100 is formed in an openable container shape, as shown in FIG. 1, and accommodates a golf accessory.

In this case, the golf accessory accommodated in the pouch body 100 may be a laser range finder, or may be any item that can be carried in the course of a golf game, such as a golf ball, a ball marker, a tee, or golf gloves.

Furthermore, the pouch body 100 may allow an inlet to be selectively opened and closed through a slide fastener 110 called a zipper. Alternatively, the inlet, may be opened and closed by a snap button method or a buckle method. The pouch body 100 may be made of a fiber material, a synthetic resin material, or a leather material, and may accommodate a golf accessory.

The magnet 200 is configured to enable the pouch body 100 to be conveniently carried through the easy attachment and detachment of the pouch body 100 by attaching the pouch body 100 to a metal plate.

In this case, the metal plate is provided on the belt or bottoms of golf wear, and provides a fixing portion for the pouch body 100. Alternatively, the metal plate may provide a fixing portion for the pouch body 100 in the state of being installed on golf equipment such as a golf bag.

The magnet 200 is fixed to one surface of the pouch body 100 through the magnet holder 300 to be described later and provides magnetic force, thereby fixing the pouch body 100 to the metal plate through an attractive action with the metal plate.

In this case, although the magnet 200 may be composed of a plate-shaped neodymium magnet having a predetermined area, it is not limited thereto, and any configuration capable of providing an attractive action with a metal plate through magnetic force may be applied.

The magnet holder 300 is a component configured to fix the magnet 200 to one surface of the pouch body 100.

In other words, the magnet 200 may be attached to the metal plate of golf wear or golf equipment, through magnetic force in the state in which the magnet. 200 is fixed to one surface of the pouch body 100 by the magnet holder 300.

The magnet holder 300 is one embodiment, and may include a fixing band 310 and a band fixing part 320, as shown in FIG. 1.

The fixing band 310 is a component fixed to one surface of the pouch body 100 with the magnet 200 accommodated between itself and the pouch body 100.

More specifically, the fixing band 310 may be formed in the shape of a band having a larger area than the magnet 200, and may form an accommodation space for the magnet 200 together with the pouch body 100 with the outer portion of the fixing band 310 fixed to the pouch body 100 through the band fixing part 320 to be described later.

The fixing band 310 may be made of the same material as the pouch body 100.

The band fixing part 320 is a component configured to fix the magnet 200 to one surface of the pouch body 100 by fixing the outer edges of the fixing band 310 to the pouch body 100.

The band fixing part 320 may be configured to fix all the outer edges of the fixing band 310 to one surface of the pouch body 100, as shown in FIG. 1.

In this case, the band fixing part 320 may fix the outer edges of the fixing band 310 by a method suitable for the material of the fixing band 310 and the pouch body 100. When the fixing band 310 and the pouch body 100 are made of a fiber material, all the outer edges of the fixing band 310 may be fixed to the pouch body 100 by a sewing method.

Meanwhile, the band fixing part 320 may be configured to include sewing portions 321 and a band fastener 322, as shown in FIGS. 2 and 3.

The sewing portions 321 are components configured to form the fixing band 310 in a ring or pocket shape by fixing only parts of the outer edges of the fixing band 310 to the pouch body 100.

More specifically, as shown in FIG. 2, the fixing band 310 may be formed in a ring shape having open left and right sides by fixing the upper and lower opposite ones of the outer edges of the fixing band 310, forming the sewing portions 321, to the pouch body 100.

Alternatively, the fixing band 310 may be formed in a pocket shape having one open outer edge by fixing three neighboring outer edges to the pouch body 100, as shown in FIG. 3.

In this case, when the fixing band 310 is formed in a ring or pocket shape by the sewing portions 321, the magnet 200 may be separated from an accommodation space by opening the accommodation space formed in conjunction with the pouch body 100.

The band fastener 322 is a component; configured to allow the accommodation space for the magnet 200 to foe opened by detachably fixing the outer edge of the fixing band 310, which is not fixed by the sewing portions 321, to the pouch body 100.

More specifically, the band fastener 322 detachably fix the left and right opposite outer edges of the fixing band 100 to the pouch body 100, as shown in FIG. 2, so that the fixing band 100 may be converted into a ring shape in response to the opening of the accommodation space.

In this case, the fixing band 310 may allow the magnet 200 to be separated from the accommodation space by opening the accommodation space through the releasing of the band fastener 322, and may be fitted and coupled over the belt of golf wear by being converted into a ring shape.

Meanwhile, as shown in FIG. 3, the band fastener 322 detachably fixes one of the upper, lower, left, and right outer edges of the fixing band 310, which is not fixed by the sewing portions 321, to the pouch body 100, thereby allowing an accommodation space for the magnet 200 to be selectively opened and closed while forming the fixing band 310 in a pocket shape.

In this case, the band fastener 322 may include a pair of Velcro fasteners 322*a* and 322*b*, so that the outer edges of the fixing band 310 can be detachably fixed to the pouch body 100.

More specifically, the Velcro fasteners 322*a* and 322*b* are respectively attached to an outer edge of the fixing band 310 and the pouch body 100 and are coupled to each other while forming a male and female pair, as shown in FIGS. 2 and 3.

Alternatively, the band fastener 322 may include a pair of male and female snap buttons or slide fasteners instead of the Velcro fasteners, so that they may detachably fix the outer edge of the fixing band 310 to the pouch body 100 while being coupled to each other. Alternatively, the band fastener 322 may include a pair of male and female magnets composed of positive and negative poles, and they may be coupled to each other.

Meanwhile, as another embodiment, the magnet holder 300 may be configured to include a magnet pocket 350 and a pocket fixing part 360, as shown in FIG. 4.

The magnet pocket 350 is a component formed in the shape of a pocket having a larger area than the magnet 200 to accommodate the magnet 200.

In other words, the above-described fixing band 310 includes a single member and forms an accommodation space together with the pouch body 100, whereas the magnet pocket 350 includes two members and forms an accommodation space for the magnet 200 between the two members while being formed in the shape of a pocket.

This magnet pocket 350 is configured such that the outer edges of the two members are fixed to each other while the two members accommodate the magnet 200 in the accommodating space therebetween, so that the magnet 200 may not be separated from the accommodating space, and a part of the outer edges of the magnet pocket 350 may be detachably fixed via the above-described Velcro fastener, so that the separation of the magnet 200 can be allowed through the opening of the accommodation space.

The pocket fixing part 360 is a component configured to fix parts of the outer edges of the magnet pocket 350 to the pouch body 100 and forms the magnet pocket 350 in a ring shape, thereby allowing both attachment using the magnetic force of the magnet 200 and attachment through a ring when the pouch body 100 is fixed.

The pocket fixing part 360 may be configured to include a pocket sewing portion 361 and a pocket fastener 362, as shown in FIG. 4.

The pocket sewing portion 361 may fix one of the upper, lower, left, and right outer edges of the magnet pocket 350 to the pouch body 100.

In this case, it is preferable that the pocket sewing portion 361 fix one of the upper and lower outer edges of the magnet pocket 350 to the pouch body 100. The pocket fastener 362 is a component configured to allow the opening of a ring while forming the magnet pocket 350 in the shape of a ring together with the pocket sewing portion 361.

More specifically, the pocket fastener 362 detachably fixes the outer edge of the magnet pocket 350, opposite to the pocket sewing portion 361, to the pouch body 100, so that the magnet pocket 350 may be formed in the shape of a ring through the fixation with the pouch body 100 and the opening of a ring may be allowed through the separation of a fixed portion from the pouch body 100.

Accordingly, the magnet pocket 350 may be attached to the metal plate of golf wear via the magnetic force of the magnet 200, or may be coupled to the belt of golf wear via the ring. When the magnet pocket 350 is coupled to the belt, the ring may be opened through the separation of the pocket fastener 362, so that the magnet pocket 350 can be easily fitted and coupled over the belt.

In this case, the pocket fastener 362 may include a pair of Velcro fasteners 362*a* and 362*b*, and may detachably fix one outer edge of the magnet pocket 350 to the pouch body 100.

More specifically, the Velcro fasteners 362*a* and 362*b* may be attached to the outer edge of the magnet pocket 350 and the pouch body 100, respectively, and coupled to each other while forming a male and female pair, as shown in FIG. 4.

Alternatively, the pocket fastener 362 may include a pair of male and female snap buttons or slide fasteners instead of the Velcro fasteners, and may separately fix one outer edge of the magnetic pocket 350 to the pouch body 100 while being coupled to each other. Alternatively, the pocket fastener 362 may include a pair of male and female magnets composed of positive and negative poles, and may be coupled to each other.

A method of using the accessory pouch 10 for golf according to an embodiment, which includes the above components, will be described.

A user may store a golf accessory such as a range finder, a golf tee, a golf ball, or the like in the pouch body 100, and may then attach the pouch body 100 to golf wear or golf equipment.

In this case, the pouch body 100 may be easily attached by being attached to the metal plate of golf wear or golf equipment through the magnetic force of the magnet 200 fixed to one surface by the magnet holder 300. When a golf accessory is used, the pouch body 100 may be easily separated from the metal plate.

Meanwhile, a user may attach the pouch body 100 by hooking the pouch body 100 on the belt of golf wear.

In this case, when the magnet holder 300 is composed of the fixing band 310, a user separates the band fastener 322 at the left and right outer edges of the fixing band 310, separates the magnet 200 from the accommodation space of the band 310, and then attaches the fixing band 310 to the belt by fitting the belt, into the fixing bond 310 forming a ring shape.

Meanwhile, when the magnet holder 300 is composed or the magnet pocket 350, a user attaches the magnet pocket 350 to the belt by fitting the belt into the magnet pocket 350 forming a ring shape, or attaches the magnet pocket 350 to the belt by opening the ring through the separation of the ring through the separation of the pocket fastener 362, fitting the magnet pocket 350 over the belt, and then fastening the pocket fastener 362 again.

As described above, according to the accessory pouch 20 for golf according to an embodiment, the pouch body 100 may be easily attached to golf wear by attaching the pouch body 100 to the metal plate using the magnetic force of the magnet 200. In addition, since the fixing band 310 or the magnet pocket 350 may be formed in the shape of a ring, the pouch body 100 may be attached to the belt of golf wear by hooking it on the belt as needed.

According to any one of the above-described solutions to the problems, there is presented the accessory pouch for golf that may protect an accessory, such as a range finder, from an external environment by accommodating the golf accessory in the pouch body and that may allow the pouch body to be easily attached to and detached from golf wear by attaching the pouch body to a metal plate provided on the golf wear using the magnetic force, of the magnet.

Furthermore, according to any one of the above-described solutions to the problems, a part of the outer edges of the fixing band configured to fix the magnet is detachably fixed, so that the fixing band may be converted into a ring shape, with the result that the fixing band may be attached to the belt of golf wear by hooking the fixing band on the belt as needed.

Furthermore, according to any one of the above-described solutions to the problems, the accommodation space of the fixing band may be opened, so that the magnet can be separated from the fixing band as needed.

Moreover, according to any one of the above-described solutions to the problems, the magnet may be fixed more firmly when the magnet is accommodated in the magnet pocket, and a ring may be opened while the magnet pocket forms a ring shape, so that the ring part can be more easily attached to the belt of golf wear.

The effects that can be obtained in the disclosed embodiments are not limited to the effects described above. Other effects not described will be clearly understood from the foregoing description by those of ordinary skill in the art to which the disclosed embodiments pertain.

The above-described embodiments are intended for illustration, and it will be easily understood by those of ordinary skill in the art to which the above-described embodiments pertain that the above-described embodiments may be easily modified into other specific forms without changing the technical spirit or essential features of the above-described embodiments. Therefore, it should be understood that the above-described embodiments are illustrative and not restrictive in all respects. For example, each component described as a single form may be implemented in a distributed form, and likewise, components described as a distributed form may also be implemented in a combined form.

The scope of the present invention to be protected through this specification is defined by the claims to be described later rather than the detailed description, and it should be appreciated that the present invention includes all changes or modifications derived from the meanings and scope of the claims and their equivalents.

What is claimed is:

1. An accessory pouch for golf for accommodating a golf accessory, the accessory pouch comprising:

a pouch body formed in an openable container, and configured to provide an accommodation space for a golf accessory;

at least one magnet provided on one surface of the pouch body, and configured to detachably attach the pouch body to a metal plate of a golf wear while providing a magnetic force; and a magnet holder configured to fix the at least one magnet to the one surface of the pouch body, wherein by configuring to release a portion of the magnet holder, previously detachably fixed to the pouch body, a shape of the magnet holder is changed to a ring shape type, the ring shape type having a structure such that an opening of a ring allows the magnet holder to be fitted and coupled to a belt of the golf wear, wherein the magnet holder comprises:

a magnet pocket formed in a pocket shape having a larger area than the at least one magnet, and configured to accommodate the at least one magnet; and a pocket fixing part configured to form the magnet pocket in a ring shape while fixing a part of outer edges of the magnet pocket to the pouch body, wherein the pocket fixing part comprises:

a pocket sewing portion configured to fix one or more of upper, lower, left, and right outer edges of the magnet pocket to the pouch body; and a pocket fastener configured to form the magnet pocket in a shape of a ring by detachably fixing one or more of the upper, lower, left, and right outer edges of the magnet pocket, opposite to the pocket sewing portion, to the pouch body, and to allow opening of the ring while allowing separation of the magnet holder detachably fixed to the pouch body, wherein the magnet pocket includes a first member and a second member disposed on the first member, and inner side surfaces of the first member and the second member form a space that accommodate the at least one magnet when the magnet pocket is formed in the pocket shape, and wherein the pocket sewing portion is configured to fix one or more of upper, lower, left, and right outer edges of the first member and the second member to each other, and the pocket fastener is configured to detachably fix one or more of the upper, lower, left, and right outer edges of the first member and the second member.

2. The accessory pouch of claim 1, wherein the pocket fastener comprises one of a pair of male and female Velcro fasteners, a pair of male and female magnets, a pair of male and female snap buttons, and a pair of male and female slide fasteners, the pocket fastener of which are attached to one outer edge of the magnet pocket and the pouch body, respectively, while forming a male and female pair and are coupled to each other.

* * * * *